US008112845B2

(12) United States Patent
Van Doorn

(10) Patent No.: US 8,112,845 B2
(45) Date of Patent: Feb. 14, 2012

(54) METHOD AND APPARATUS FOR SEPARATING FOREIGN MATTER FROM FIBROUS MATERIAL

(75) Inventor: Donald Van Doorn, Savannah, GA (US)

(73) Assignee: Lummus Corporation, Savannah, GA (US)

( * ) Notice: Subject to any disclaimer, the term of this patent is extended or adjusted under 35 U.S.C. 154(b) by 61 days.

(21) Appl. No.: 12/813,759

(22) Filed: Jun. 11, 2010

(65) Prior Publication Data

US 2010/0306966 A1 Dec. 9, 2010

Related U.S. Application Data

(63) Continuation-in-part of application No. 12/168,497, filed on Jul. 7, 2008, now Pat. No. 7,779,514.

(60) Provisional application No. 60/950,222, filed on Jul. 17, 2007.

(51) Int. Cl.
*D01B 1/06* (2006.01)

(52) U.S. Cl. ..... 19/41; 19/48 R

(58) Field of Classification Search ..... 19/39, 41, 19/48 R, 54, 64.5
See application file for complete search history.

(56) References Cited

U.S. PATENT DOCUMENTS

| | | | | | |
|---|---|---|---|---|---|
| 4,102,017 | A * | 7/1978 | Foerster | 19/203 |
| 4,223,423 | A * | 9/1980 | Foerster | 19/203 |
| 4,999,881 | A * | 3/1991 | Vandergriff et al. | 19/48 R |
| 5,173,994 | A * | 12/1992 | Gillum et al. | 19/55 R |
| 5,295,283 | A * | 3/1994 | Gillum et al. | 19/55 R |
| 5,381,587 | A * | 1/1995 | Vandergriff | 19/48 R |
| 5,414,900 | A * | 5/1995 | Gillum et al. | 19/55 R |
| 6,088,881 | A * | 7/2000 | Van Doorn et al. | 19/202 |
| 6,615,454 | B1 * | 9/2003 | Anthony | 19/41 |
| 7,779,514 | B2 * | 8/2010 | Van Doorn | 19/205 |

* cited by examiner

*Primary Examiner* — Shaun R Hurley
(74) *Attorney, Agent, or Firm* — Smith, Gambrell & Russell

(57) ABSTRACT

An apparatus for cleaning foreign matter from separated tufts of fiber uses a transfer cylinder intermediate a revolving open reel type structure mounted within a porous housing to separate a conveying air stream from tufts of fiber conveyed thereby and a toothed cleaning cylinder to separate air flow through said revolving reel from said cleaning cylinder such that air is not drawn through said cleaning cylinder into said porous housing.

15 Claims, 2 Drawing Sheets

METHOD AND APPARATUS FOR SEPARATING FOREIGN MATTER FROM FIBROUS MATERIAL

This application is a continuation in part of and jointly owned by the same assignee as application Ser. No. 12/168,497 filed on Jul. 7, 2008 now U.S. Pat. No. 7,779,514, which claims priority to U.S. provisional application No. 60/950,222, filed Jul. 17, 2007, which is incorporated herein by reference.

BACKGROUND OF THE INVENTION

This invention relates to cotton fiber processing and more particularly to an apparatus and method of separating foreign matter from fibrous cotton that has been ginned from the seed. About 60 years ago cotton "lint Cleaners" were introduced into cotton gins in the United States to overcome the dramatic increase of extraneous matter brought to the gins in the seed cotton harvested by the newly introduced mechanical cotton harvesters as compared to the previously customary hand picked (harvested) cotton. These "Saw-type" lint cleaners did indeed greatly improve the appearance of the lint by removing much "trash", but also by aggressively "combing" the tufts of fibers to diffuse them and hide the remaining fine trash particles. The most successful of these "Saw Type" lint cleaners contained a "Feed Roller" working against a concave "Feed Plate" to compact the lint batt and firmly hold it about 7 mm from the sharp tips of the fine teeth on the lint cleaner cleaning cylinder that plucked the fibers from the batt. These lint cleaners were commercially very successful because they made the lint appear to the naked eye to meet the higher grades in the classing sample standard grade boxes which were the primary determinant of the lint value along with the manually determined "staple length" which also "pulled" somewhat longer by the manual grading or classing systems of the day. Soon two and even three stages of these aggressive lint cleaners were used in series benefitting the farmers, but the results at the textile spinning mills proved disappointing.

The inadequacy of the manual-visual method of classing lint cotton became apparent, and innovative researchers introduced various cotton quality test instruments that measured spinning qualities that were only vaguely sensed by manual methods, if detected at all. Several of these test instruments were improved to perform fast enough to process lint samples as they were produced during the peak of the ginning season, and they were combined into a classing system referred to as "High Volume Instrumentation" (HVI). HVI systems were officially adopted for commerce in the United States and today HVI systems are being promoted for use around the world. However, there is much inertia in the long standing manual classing systems and the transition to HVI commercial use in many foreign countries may be very gradual.

As more of these accurate spinning quality tests were made using instrument testing equipment comparing the before and after lint quality through these saw type lint cleaners, it became clear that these lint cleaners were breaking many fibers and producing neps, both of which are very detrimental to yarn quality. The location within these saw type lint cleaners that caused this fiber quality damage was controversial, but it has now been shown that the major damage is caused at the point where the cotton batt is fed to the teeth of the cleaning cylinder.

Patent application Ser. No. 12/168,497 describes apparatus that reduces fiber damage by eliminating the formation of the cotton tufts into a batt, but rather, individually applies the tufts of cotton as they come from the gin stand in an air stream directly onto the teeth of the lint cleaner cleaning cylinder teeth without mechanically restraining the tufts. This patent application is for use with lint cleaners that have short, densely spaced teeth on a solid cylinder which currently are universally used in the U.S. saw gins on upland cotton.

Roller ginning in the United States has been almost entirely confined to ginning pima cotton which is more valuable than upland cottons because of its extra long, fine fibers that warrant the slow, more expensive roller ginning process that also breaks fewer fibers than saw ginning. However, the roller ginning process has recently been made much faster until roller ginning speed (Capacity) is now nearing saw ginning capacity per unit width of ginning machine. High speed roller ginning is now being introduced to the ginning of some upland cottons in response to monetary incentives for roller ginned lint. Roller ginned lint is classed on a different system from saw ginned lint. The roller ginned lint classing system has completely different standards for "preparation". The roller ginned "prep" standard calls for a certain lumpy appearance caused by the roller gin that pulls off much larger tufts from the seed than saw gins. The lint cleaners used with roller gins, therefore, do not as aggressively "comb" the lint to preserve the characteristic lumpy appearance of roller ginned lint. The cleaning cylinders used on roller ginned cotton generally have less densely spaced teeth or even bars or lugs which would not provide an air seal between the cleaning cylinder and the high speed separator cylinder housing as is required in application Ser. No. 12/168,497. Furthermore, the textile industry, over many years has developed several specialized cotton cleaning cylinders, including "Kirschner" and "Buckley" beaters, which have more open designs that would allow air to be drawn through the cleaning cylinder back into the high speed separator housing if the apparatus of Ser. No. 12/168,497 were used. Moreover, the open design cleaning cylinders often are self doffing and therefore they eliminate the doffing cylinder of '497, a considerable initial and maintenance expense. The principle proven benefits of Ser. No. 12/168,497 would be lost for use with these many "open" cleaning cylinders without the added concepts of the present invention.

Other prior methods and apparatus include those such as illustrated in U.S. Pat. No. 6,088,881, incorporated herein by reference, wherein a revolving perforated drum is used to allow air flow through the drum such that a cleaning cylinder may remove cotton fiber from the perforated drum and carry it past a plurality of cleaning grid bars, thereby separating the air flow and removing foreign matter from the fibers, before the fiber is doffed from the cleaning cylinder for subsequent air flow to downstream processing.

However, the perforated revolving cylinder of the '881 apparatus, revolving at velocities to prevent agglomeration of the tufts in the air stream, develops centrifugal forces that cause the fine trash and very short fibers that penetrate the perforations to accumulate on the interior surfaces of the perforated cylinder. These accumulations require the use of compressed air blasts to cause them to move axially out the open ends of the cylinder. While the compressed air blasts provide a solution to this problem of accumulations, the maintenance and cost of the compressed air system detracts from the otherwise excellent performance of the apparatus per the '881 patent.

The quality preserving actions of the methods and apparatus shown in U.S. Pat. No. 6,088,881 and application Ser. No. 12/168,497 would be beneficial for use with all types of lint cleaning cylinders, including those used with roller gins. The improvement described herein provides the solution to combining the benefits of these concepts with cleaning cylinders of most all designs.

BRIEF DESCRIPTION OF THE DRAWINGS

An apparatus embodying features of the invention is depicted in the accompanying drawing wherein.

BRIEF SUMMARY OF THE INVENTION

It is an object of the present invention to provide an improved method and apparatus for separating foreign matter from tufts of fibrous cotton. A further object of the invention is to allow the high speed separation and cleaning of upland cotton using open cleaning apparatus and a combination air seal with fiber transfer roller.

DETAILED DESCRIPTION OF THE INVENTION

Figure 1:
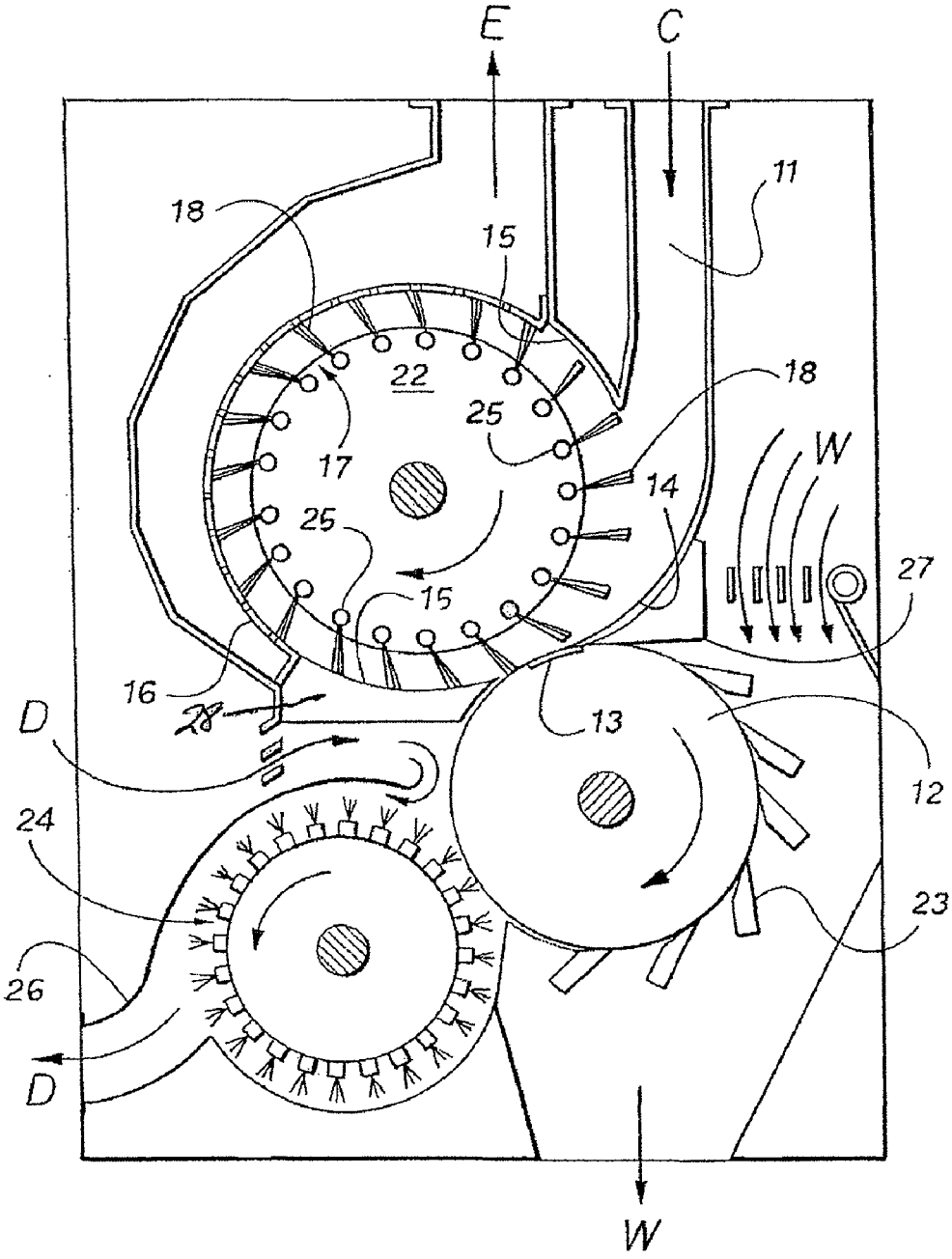
FIG. 1 is a sectional view of the apparatus disclosed in the copending patent application Ser. No. 12/168,497.

As shown in FIG. 1. patent application Ser. No. 12/168,497 depends upon the short, dense teeth of the standard cleaning cylinders used in upland cotton gin lint cleaners to seal against the air partial vacuum in the housing surrounding the "high speed air separator cylinder". This vacuum is required to induce an air stream to convey the tufts of lint to the lint cleaner. FIG. 1 taken from patent application '497 illustrates the housing around the sub atmospheric air stream entering at C and exiting at E. It also shows the air seal formed between the short, dense teeth at "13" and close fitting plate "27" preventing atmospheric pressure air from the trash removing grid area "23" being drawn into the incoming air stream C. Plate 28 also fits closely to the tips of the cleaning cylinder teeth to prevent air, coming in at D, from being drawn into the housing around the high speed air separator cylinder.

Figure 2:
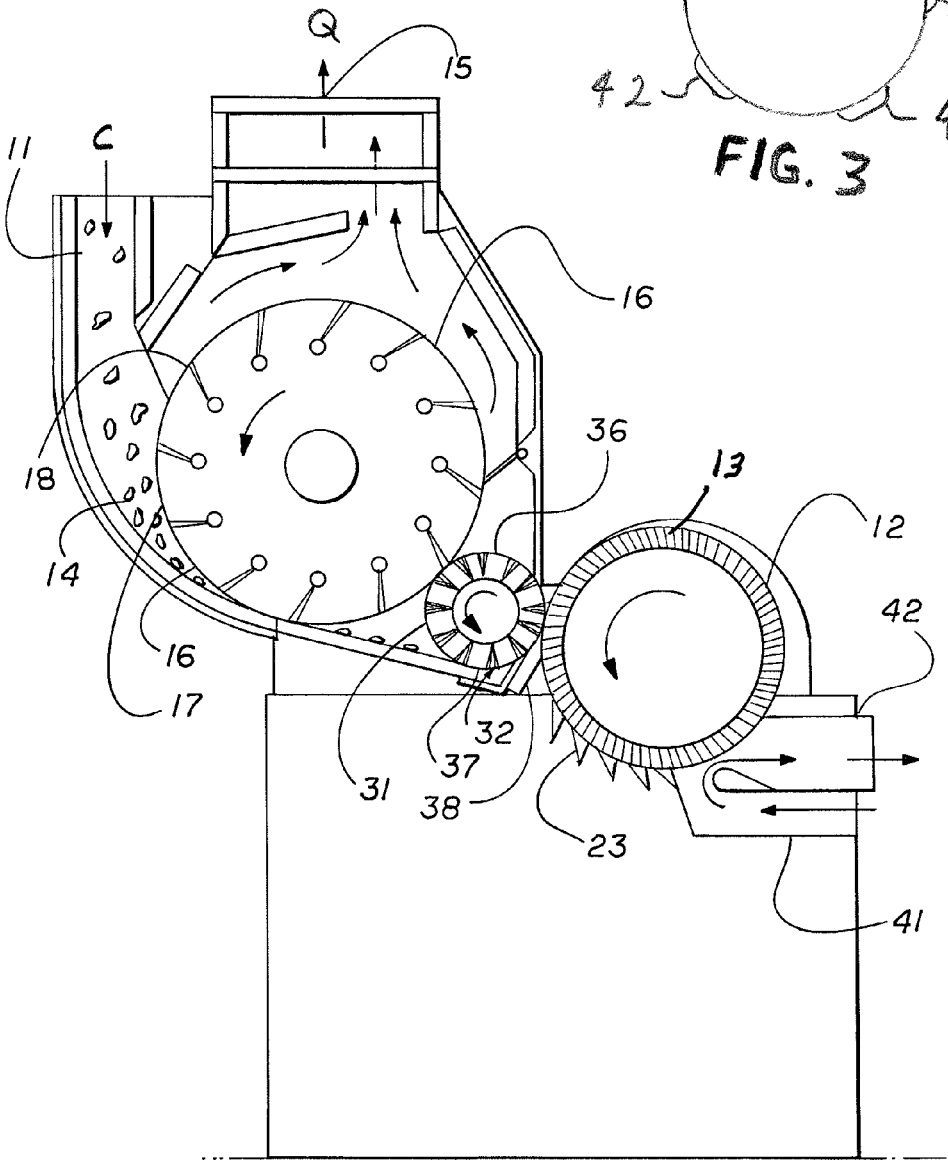
FIG. 2 is a sectional side elevational view of an embodiment of an apparatus of the present apparatus.

An improved apparatus and method according to the present invention is illustrated in FIG. 2, wherein fiber tufts comingled with foreign matter are pneumatically carried by a conveying air stream C into the apparatus via an air duct 11 as is well known in the art. FIG. 2 is a cross sectional illustration of a preferred embodiment containing most of the features of the present invention. Fiber tufts, commingled with foreign matter, are conveyed into the entry duct 11 of the apparatus by a high speed air stream preferably under sub atmospheric air pressure. Entry duct 11 converges arcuately toward the periphery of high speed air separator cylinder 17 that is pervious to both inward and outward flow of fiber, foreign matter and air. However, the arcuate convergence of duct 11 combined with the high speed arcuate change of direction develops centrifugal forces urging the fiber and foreign matter to move toward the converging surface 14 of duct 11. Approximately diametrically opposite the point on the separator cylinder where the duct 11 converges against the periphery of the air separator cylinder 17 is a stationary arcuate section of perforated screen 16 closely following the arc of the periphery of separator cylinder 17. The perforated screen 16 is pervious to air flow there through, but impervious to desirable fiber. Any fiber that collects on the screen is immediately swept away from the screen by a plurality of circumferentially spaced outer surfaces 18 that are spaced apart circumferentially to allow the conveying air and entrained dust and fine foreign matter particles to pass through the screen 16 and exit the apparatus via an air discharge duct 15 at Q. As outer surfaces 18 rotate across perforated surface 16 the surfaces 18 substantially sweep away any accumulations of matter on the stationary separator surface 16 and return any desirable fiber back to the conveying air stream proximal terminal portion 14 of duct 11. The rotation of revolving outer surfaces 18 is such that the commingled fiber and foreign matter are exposed to the surface 32 of air seal and fiber transfer cylinder 31 while the revolving outer surfaces 18 are rotating toward stationary semi cylindrical surface 16.

Up to this point the present invention follows the teachings of patent application Ser. No. 12/168,497 and the preferred embodiment of the present invention likewise follows FIG. 1 of patent application Ser. No. 12/168,497. But from this point on the preferred embodiment of the present invention deviates from patent application Ser. No. 12/168,497 in that it calls for the addition of the air seal and fiber transfer cylinder 31 between the air separator cylinder 17 and the cleaning cylinder 12 as shown in FIG. 2. As will be understood from the prior art, the rotation of cleaning cylinder 12 carries the tufts past a stripping bar and plurality of cleaning grid bars 23 disposed to separate a major portion of foreign matter from the cotton tufts on the cleaning cylinder 12, which foreign matter may be disposed via a trash conveyor system for subsequent collection and baling. As noted above, roller ginning is generally used for the higher quality cottons and the lint cleaning machinery often uses longer, more widely spaced pin or lug type cylinders which would not prevent air flow back into the high speed separator section that is under sub atmospheric air pressure.

Air seal and fiber transfer cylinder 31 is needed for use with such a cleaning cylinder 12 that has longer, less dense teeth or lugs that would allow air to be pulled back from the trash removing grid section into the sub atmosphere air pressure housing around the high speed air separator cylinder 17. In the present apparatus, as shown in FIG. 2, cylinders 17, 31, and 12, all revolve counter clockwise and preferably successively at increasing surface speeds. Air seal and fiber transfer cylinder 31 primarily acts as what is generally known as a "vacuum wheel". To make this air seal, air seal and fiber transfer cylinder 31 must fit tightly against arcuate walls 37 and 36 both on the fiber carrying side and the return side of the cylinder 31 and it must be constructed to prevent air from passing through the air pressure differential across the cylinder at all times in its rotation. Also this cylinder 31 must be capable of carrying the fibers around the arcuate fiber transfer side, preferably while holding the fiber tufts firmly in place as they enter the pinch point between this cylinder and the arcuate wall 37 on the fiber carrying side and hold the tufts until they are released to the tip of a streamer plate 38 at the end of the arcuate wall from which the fibers are pulled by the teeth of cleaning cylinder 12. Thus, in one embodiment, the surface 32 of air seal and transfer cylinder 31 is of a dense brush type consistency that will engage fibers and present a dense but flexible seal in the interstice between the cylinder 31 and the walls 36 and 37. Such a brush like surface would preferentially be composed of bristles spaced less than about 6 millimeters apart over the surface of the transfer cylinder.

The surface of cylinder 31 should preferably be radially flexible and continuous to maintain an air seal at all times both on the lower, fiber exit side and upper return side of cylinder 31 running against stationary arcuate sealing surfaces 36 and 37 that join to the housing around separator cylinder 17. As noted preferred outer surface for cylinder 31 is composed of continuous, dense brush bristles that entrap the fiber tufts against arcuate surface 36 and an adjustable streamer plate 38 which has an acute angle fiber delivery tip to uniformly "pay-out" the fiber tufts to the teeth of the faster moving surface of cleaning cylinder 12. That is to say, streamer plate 38 converges to a tip or edge at the interstice of cylinders 31 and 12 with the converging sides being substantially tangent to the adjacent cylinders. Streamer plate is mounted such that it can be mechanically adjusted as is well known in the industry relative to the transfer cylinder 31 and the cleaning cylinder 12, such that fiber tufts being carried past sealing surface 36 is exposed at the tip or edge of streamer plate 38 to the teeth 13 of cleaner cylinder 12, such that the fibers may be removed from transfer cylinder 31 for processing by cleaning cylinder 12. By way of example, streamer plate 38 may be adjusted by appropriate shims or by incorporating an adjustment slot and selectively tightened bolts to allow the plate to vary in inclination and projection.

Figure 3:
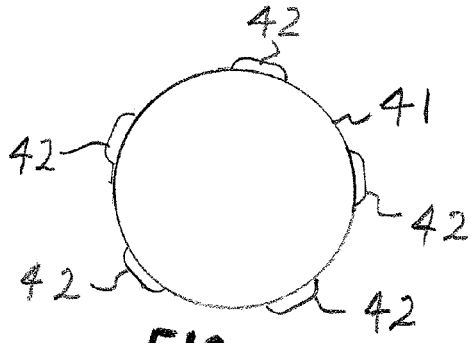
FIG. 3 is a partial sectional side elevational view of another embodiment of the transfer wheel of the present apparatus.

It should also be noted that cylinder 31 may be in the form of an air wheel having a solid cylindrical core 41 and a plurality of angularly spaced radially extending flights 42 or brushes which resiliently engage walls 36 and 37 as shown in FIG. 3. The flights 42 would be angularly spaced at distances less than the arc defined by wall 36 or 37 such that at least one flight 42 would be in sealing engagement with wall 36 and another in sealing engagement with wall 37 at all times, thereby preventing the flow of air past cylinder 31. Flights 42 would be sufficiently resilient to carry the fiber tufts past wall 36 to where the fibers would be engaged by cleaning cylinder 12. The flights 42 may be brushes, belts or other strip like material.

As will also appreciated, a rotating doffing cylinder or brush 24 can remove the cleaned tufts from the teeth 13 of cleaning cylinder 12 and deliver the cleaned fibers to duct 26. FIG. 2 also shows a form of air flow doffing without a doffing cylinder often used with the more open cleaning cylinders. As may be seen the doffing airstream through inlet duct 41 and outlet duct 42 moves in conjunction with the rotating teeth or lugs of cylinder 12 such that fibers are readily entrained in the airflow. The present invention makes air doffing without a doffing cylinder usable with the proven advantages of the high speed separator taught in application Ser. No. 12/168,497.

While the forgoing specification describes only a few embodiments of the present invention, the invention is not so limited and is intended to encompass the full scope of the claims appended hereto.

I claim:

1. In a fiber cleaning apparatus including a revolving cleaning cylinder capable of engaging fiber tufts to separate said fiber from comingled foreign matter in which fiber tufts commingled with foreign matter are pneumatically conveyed into the apparatus in an air stream, flowing through an air duct, said air duct terminating at an outlet, the improvement comprising: a separator reel mounted for rotation about an axis parallel said cleaning cylinder and positioned adjacent said outlet, said reel partially circumscribed by a screen pervious to air flow and impervious to said tufts such that air flow passing through said reel exits through said screen depositing any entrained tufts thereon, and, an air seal and fiber transfer cylinder mounted for rotation about an axis parallel said separator reel and said cleaning cylinder and disposed there between to receive fiber tufts directly from said outlet and from said revolving reel and to transfer said fiber tufts along a substantially air tight path to said cleaning cylinder.

2. The fiber cleaning apparatus of claim 1 wherein said air seal and fiber transfer cylinder rotates within walls closely adjacent said air seal and fiber transfer cylinder, said cylinder including an outer surface having a consistency adapted to engage fibers and present a dense seal in the interstice between said air seal and transfer cylinder and said closely adjacent walls.

3. The fiber cleaning apparatus of claim 1, wherein the revolving separator reel comprises a plurality of outer surfaces circumferentially spaced to allow the air stream to pass through said reel without abruptly increasing the air stream velocity.

4. The fiber cleaning apparatus of claim 2, wherein said separator reel is driven for rotation such that the spaced outer surfaces direct fiber tufts and foreign matter toward the surface of said air seal and transfer cylinder.

5. The fiber cleaning apparatus of claim 3, wherein the outer surfaces are disposed to sweep tufts and larger foreign matter from the stationary screen to the air stream upstream of said separator reel.

6. The fiber cleaning apparatus of claim 3, wherein the outer surfaces comprise a flexible belt-like strip with a length running generally parallel to the axis of rotation of the revolving reel and a width extending generally radially from the axis of rotation.

7. The fiber cleaning apparatus of claim 3, wherein the outer surfaces comprise a brush strip with a length running generally parallel to the axis of rotation of the revolving separator and a width extending generally radially from the axis of rotation.

8. The fiber cleaning apparatus of claim 1, wherein said separator reel moves at velocities that develop centrifugal forces sufficient to cause the tufts and foreign matter revolving with said outer surfaces to move radially outwardly.

9. A fiber cleaning apparatus in which fiber tufts are pneumatically conveyed substantially individually through an air duct terminating at an outlet an air stream commingled with foreign matter comprising:

a transfer cylinder, mounted for rotation about a first axis and proximal said outlet, capable of holding the fiber tufts and of carrying said fiber tufts past closely abutting sealing surfaces while holding said fiber tufts, said air duct directing a primary portion of the fiber tufts directly to said transfer cylinder as it rotates proximal said outlet;

a rotating cleaning cylinder mounted for rotation about an axis parallel said first axis and having a plurality of teeth passing proximal said transfer cylinder to remove said fiber tufts there from and separate said fibers tufts from motes entrained therewith wherein said transfer cylinder and said sealing surfaces substantially prevent the flow of air from said cleaning cylinder to said outlet.

10. The fiber cleaning apparatus of claim 9, further comprising a revolving separator reel mounted for rotation about an axis parallel said first axis and positioned adjacent said outlet, said reel partially circumscribed by a screen pervious to air flow and impervious to said tufts such that air flow passing through said reel exits through said screen depositing said fiber tufts thereon, said revolving separator reel comprising circumferentially spaced outer surfaces for sweeping the desired fiber tufts and accumulated foreign matter from said stationary separator screen and returning the desired fiber tufts and foreign matter to the airstream proximal said transfer cylinder.

11. The fiber cleaning apparatus of claim 9 wherein said transfer cylinder comprises a substantially solid cylinder and a plurality of radially and longitudinally extending resilient members engaging said sealing surfaces, said radially extending resilient members spaced circumferentially from each other about said solid cylinder by a distance less than the dimension of said sealing surfaces such that at least one of said radially extending members engage each of said sealing surfaces along the full axial length of opposite sides of said transfer cylinder at any given time.

12. The fiber cleaning apparatus of claim 9 wherein said transfer cylinder comprises a substantially solid cylinder having a resilient brush like surface for engaging said tufts and carrying said tufts past a first one of said sealing surfaces to engagement by said cleaning cylinder.

13. The fiber cleaning apparatus of claim 12 wherein said brush like surface comprises a plurality of bristles extending from said cylinder and spaced less than about six millimeters from each other.

14. The fiber cleaning apparatus of claim 9 further comprising a duct for delivering a doffing airstream to said cleaning cylinder to remove fiber tufts there from downstream of said transfer cylinder and entrain said tufts in said doffing airstream.

15. The fiber cleaning apparatus of claim 9 further comprising an adjustable streamer plate adjustably mounted proximal said transfer cylinder and said cleaning cylinder for delivering fiber tufts from said transfer cylinder in position for engagement by said cleaning cylinder.

* * * * *